US009358778B2

(12) United States Patent
Gila et al.

(10) Patent No.: US 9,358,778 B2
(45) Date of Patent: Jun. 7, 2016

(54) INKJET IMAGING METHODS, IMAGING METHODS AND HARD IMAGING DEVICES

(71) Applicant: HEWLETT-PACKARD DEVELOPMENT COMPANY, L.P., Houston, TX (US)

(72) Inventors: Omer Gila, Palo Alto, CA (US); Ronald Albert Askeland, Sant Cugat del Valles (ES); Yossi Rosen, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/152,655

(22) Filed: Jan. 10, 2014

(65) Prior Publication Data

US 2014/0125747 A1 May 8, 2014

Related U.S. Application Data

(63) Continuation of application No. 12/990,617, filed on Nov. 1, 2010, now Pat. No. 8,628,190.

(51) Int. Cl.

| | |
|---|---|
| ***B41J 2/01*** | (2006.01) |
| ***B41J 2/005*** | (2006.01) |
| *B41J 11/00* | (2006.01) |

(52) U.S. Cl.

CPC ..... *B41J 2/0057* (2013.01); *B41J 11/002* (2013.01)

(58) Field of Classification Search

CPC ..... B41J 2/0057

See application file for complete search history.

(56) References Cited

U.S. PATENT DOCUMENTS

| | | | | |
|---|---|---|---|---|
| 5,365,261 | A | 11/1994 | Ozawa et al. | |
| 6,354,701 | B2 | 3/2002 | Korem | |
| 6,639,527 | B2 | 10/2003 | Johnson | |
| 6,648,466 | B2 | 11/2003 | Beauchamp et al. | |
| 6,648,470 | B2 | 11/2003 | Korem | |
| 6,716,562 | B2 * | 4/2004 | Uehara et al. | 430/125.3 |
| 6,767,092 | B2 * | 7/2004 | May et al. | 347/103 |
| 7,078,141 | B2 | 7/2006 | Ben-Avraham et al. | |
| 7,316,474 | B2 | 1/2008 | Tatsumi et al. | |
| 8,033,662 | B2 | 10/2011 | Konno | |
| 8,628,190 | B2 * | 1/2014 | Gila et al. | 347/103 |
| 2002/0071704 | A1 | 6/2002 | Korem | |

(Continued)

FOREIGN PATENT DOCUMENTS

| | | | |
|---|---|---|---|
| JP | 62087387 A | * | 4/1987 |
| JP | 2008006816 | | 1/2008 |
| JP | 2008080656 | | 10/2008 |

OTHER PUBLICATIONS

Kipphan, H., "Elcography", Handbook of Print Media, Oct. 2001, pp. 752-758.

(Continued)

*Primary Examiner* — Omar R Rojas

(74) *Attorney, Agent, or Firm* — Wells St. John Roberts, Gregory & Matkin

(57) ABSTRACT

Hard imaging methods and devices are described. In at least some examples, a method includes ejecting a plurality of droplets of a liquid marking agent corresponding to the image to be formed, wherein the droplets of the liquid marking agent individually comprise a plurality of ink particles. The droplets are received upon a transfer member, and after the receiving, at least the ink particles are transferred from the transfer member to media to form a hard version of the image using the media.

21 Claims, 13 Drawing Sheets

(56) References Cited

U.S. PATENT DOCUMENTS

| | | | | |
|---|---|---|---|---|
| 2003/0189628 | A1 | 10/2003 | Kaga et al. | |
| 2004/0070656 | A1 | 4/2004 | May et al. | |
| 2006/0164489 | A1 | 7/2006 | Vega et al. | |
| 2007/0265372 | A1* | 11/2007 | Liu | 523/160 |
| 2007/0279471 | A1 | 12/2007 | Tombs et al. | |

OTHER PUBLICATIONS

EPO, Extended Search Report, Apr. 4, 2014, 6 pages.

* cited by examiner 12
48
42
46
40
28
26
50
44

12
48
42
46
40
28
29
26
44

INKJET IMAGING METHODS, IMAGING METHODS AND HARD IMAGING DEVICES

CROSS-REFERENCE TO RELATED APPLICATIONS

This Utility Patent Application is a Continuation of U.S. application Ser. No. 12/990,617, entitled INKJET IMAGING METHODS, IMAGING METHODS AND HARD IMAGING DEVICES, filed Nov. 1, 2010, incorporated by reference herein.

FIELD OF THE DISCLOSURE

Aspects of the disclosure relate to inkjet imaging methods, imaging methods and hard imaging devices.

BACKGROUND OF THE DISCLOSURE

Imaging devices capable of printing images upon paper and other media are ubiquitous and used in many applications including monochrome and color applications. The use and popularity of these devices continues to increase as consumers at the office and home have increased their reliance upon electronic and digital devices, such as computers, digital cameras, telecommunications equipment, etc.

A variety of methods of forming hard images upon media exist and are used in various applications and environments, such as home, the workplace and commercial printing establishments. Some examples of devices capable of providing different types of printing include laser printers, impact printers, inkjet printers, commercial digital presses, etc. The various printing methods and devices involve different technologies to form hard images upon media and the individual types of methods and devices may be more suitable for one or more application or use compared with other applications or uses.

At least some aspects of the present disclosure are directed towards improved hard imaging devices and hard imaging methods.

SUMMARY

According to some aspects of the disclosure, inkjet imaging methods, imaging methods and hard imaging devices are described.

According to one aspect, an imaging method includes accessing image data of an image to be formed; using the image data, controlling a print device to eject a plurality of droplets of a liquid marking agent corresponding to the image to be formed, wherein the droplets of the liquid marking agent individually comprise a plurality of ink particles; using the print device, ejecting the droplets of the liquid marking agent; after the ejecting, receiving the droplets of the liquid marking agent upon a transfer member; and after the receiving, transferring the ink particles of the droplets from the transfer member to media to form a hard version of the image using the media.

According to another aspect, a hard imaging device comprises a print device configured to eject a plurality of droplets of a liquid marking agent, the droplets of the liquid marking agent individually comprising a plurality of ink particles; a control device configured to control the print device to eject the droplets of the liquid marking agent corresponding to an image to be formed; and a transfer member adjacent to the print device and configured to receive the droplets of the liquid marking agent ejected by the print device, wherein the transfer member is configured to transfer the ink particles of the droplets from the transfer member to media to form a hard version of the image using the media.

Other embodiments and aspects are described as is apparent from the following discussion.

DESCRIPTION OF THE DRAWINGS

FIG. 4 is an illustrative representation of a liquid removal system according to one embodiment.

FIG. 4*a* is a plan view of a liquid removal system according to one embodiment.

FIG. 4*b* is an illustrative representation of a liquid removal system according to one embodiment.

FIG. 4*c* is an illustrative representation of a liquid removal system according to one embodiment.

FIG. 4*d* is an illustrative representation of a liquid removal system according to one embodiment.

FIG. 4*e* is an illustrative representation of a liquid removal system according to one embodiment.

FIG. 5*b* is an illustrative representation of a liquid removal system according to one embodiment.

DETAILED DESCRIPTION

At least some embodiments of the present disclosure are directed towards hard imaging devices and hard imaging methods for forming hard images upon media. In one specific example, apparatus and methods are disclosed which utilize inkjet printing in an offset printing arrangement. For example, an inkjet print head is utilized to provide a plurality of droplets of a liquid marking agent upon a transfer member in one embodiment. Different compositions of the liquid marking agent are possible and may utilize a non-aqueous liquid carrier or vehicle which contains ink particles for forming images in one embodiment. After provision of the droplets upon the transfer member, at least a portion of a liquid carrier of the liquid marking agent is removed and ink particles of the liquid marking agent remaining upon the transfer member are transferred to media to produce hard versions of images upon the media. Additional embodiments and aspects are described in the following disclosure.

Figure 1:
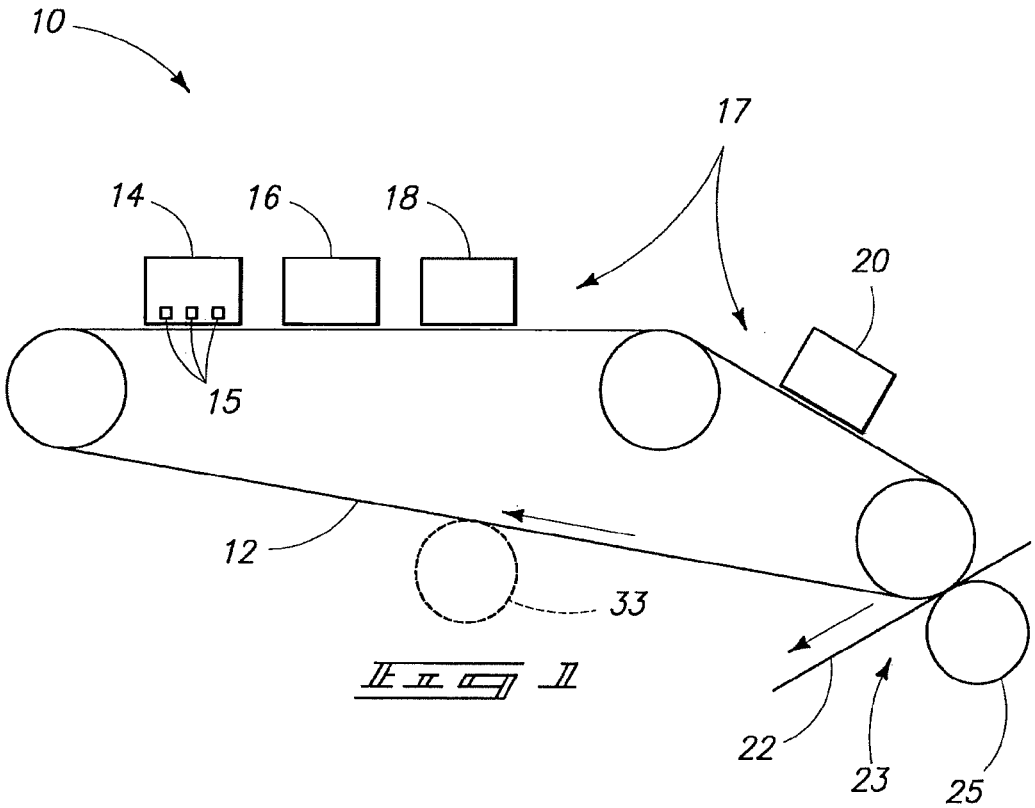
FIG. 1 is an illustrative representation of a hard imaging device according to one embodiment.

Referring to FIG. 1, an example configuration of a hard imaging device 10 is illustrated according to one embodiment. The embodiment of the hard imaging device 10 shown in FIG. 1 includes a transfer member 12 which is configured to receive a liquid marking agent and to transfer ink particles of the received liquid ink marking agent to media 22 to form hard versions of images thereon (e.g., hard versions of images include images which are printed, copied or otherwise fixed to the media) as discussed further below. Hard imaging device 10 additionally includes a print device 14, a development device 16, and a liquid removal system 17 positioned adjacent to the transfer member 12 in the illustrated embodiment. Other embodiments of hard imaging device 10 are possible including more, less or alternative components than the arrangement illustrated in FIG. 1.

In the illustrated embodiment, transfer member 12 is a transfer belt and may be referred to as a blanket. Other transfer members are possible, such as a drum or other structure appropriate for receiving and transferring a marking agent. Additional details regarding one possible configuration of transfer member 12 in the form of a belt are described below with respect to FIG. 2.

Print device 14 is configured to provide a liquid marking agent upon the transfer member 12 moving in a clockwise direction in the example of FIG. 1. In one embodiment, print device 14 is an inkjet print head which is configured to eject a plurality of droplets of a liquid marking agent which correspond to an image. In one embodiment, print device 14 configured for inkjet imaging comprises a plurality of nozzles 15 configured to eject a plurality of droplets of the liquid marking agent upon the transfer member 12 at a plurality of different locations (e.g., corresponding to pixel locations of an image) and which are used to form hard images upon media 22. In example embodiments, print device 14 may be configured as a piezoelectric inkjet print head or a thermal inkjet print head arranged to accommodate aqueous or non-aqueous carriers in at least one embodiment. In some thermal inkjet print head arrangements, the boiling point of the liquid marking agent may be lowered to facilitate jetting. In one embodiment, a liquid carrier of approximately 10% isopropyl alcohol and 90% ISOPAR L available from Exxon-Mobil Corporation was used in an example thermal inkjet print head application.

The liquid marking agent received by or deposited upon the transfer member 12 corresponds to the image to be formed upon media 22 in one embodiment. For example, a control device (described below with respect to FIG. 8) processes image data and controls the nozzles 15 of the print device 14 to eject droplets of the liquid marking agent at appropriate locations to form an image specified by the image data.

One example of a liquid marking agent comprises ink particles suspended in a liquid carrier in one embodiment. Different liquid carriers are possible and may include non-aqueous carrier fluids in different embodiments. Examples of non-aqueous carriers include solvent (e.g., alcohol) and/or oil-based carriers (e.g., Isopar L) in one embodiment. As discussed below, utilization of a non-aqueous carrier has advantages with respect to removal of the carrier compared with aqueous carriers in some embodiments. In one embodiment, a suitable non-aqueous carrier fluid is entirely void of water. In another embodiment, a suitable non-aqueous carrier fluid is substantially void of water. In yet another embodiment, a suitable non-aqueous carrier fluid may include water in an amount which does not significantly adversely impact the operations described herein to remove the carrier fluid from the transfer substrate 12 prior to transfer of ink particles from the transfer member 12 to media 22 described herein. In one more specific example, a non-aqueous carrier preferably includes less than 1% water and no more than 5% water.

The ink particles (e.g., pigment particles) are smaller than typical toner particles and may comprise different pigments for color applications or a single color for monochrome applications. In one embodiment, the ink particles have diameters within a range of 50-500 nm. The ink particles may or may not be individually encapsulated with a resin (e.g., suitable plastics or polymers are described in U.S. Pat. No. 7,078,141, the teachings of which are incorporated herein by reference, in one embodiment). Encapsulated ink particles may have a diameter of 200 nm in one example. In some liquid marking agent compositions, free floating particles of the resin may also be provided within the liquid carrier. The resin may assist with adhesion of the ink particles to media 22 during image formation operations. In one embodiment, the liquid marking agent comprises approximately 5% solids including the ink particles.

In another example composition of the liquid marking agent, the ink particles and a plurality of charge directors are suspended in the liquid carrier. Examples of suitable charge directors which may be used are described in the '141 patent incorporated herein by reference above. The charge directors may carry an electrical charge of a common polarity (e.g., positive charge in one example). The ink particles may be coated with the above-mentioned resin in arrangements of the liquid marking agent which include charge directors. Various liquid marking agents, such as Electroink, including ink particles and charge directors suspended in a liquid carrier are available from the Hewlett Packard Company.

In one embodiment, development device 16 is downstream of the print device 14 and is configured to develop the droplets to substantially fix the size of the areas of the droplets upon the transfer member 12 (e.g., reduce areas of expansion of the droplets upon the transfer member 12). For example, in one embodiment, development device 16 is configured to urge or direct the ink particles 12 against the transfer member 12 to develop the droplets and ink particles. In one embodiment, the development device 16 imparts an electrical force (e.g., electrical field, electrical charge, electrons) to the liquid marking agent deposited upon the transfer member 12. In one embodiment, the ink particles may be charged to have a common polarity (e.g., negative charge in one example) prior to provision of the liquid marking agent upon the transfer member 12. In one embodiment, the imparting of an electrical charge of the same polarity as the charge of the ink particles (e.g., negative charge) from a location opposite to the outward surface of the transfer member 12 compresses the ink particles upon the transfer member 12 which operates to separate the ink particles of the liquid marking agent from the liquid carrier and reduces areas of expansion of the ink particles and droplets upon the transfer member and substantially fixes the areas of the droplets deposited upon the transfer member 12. The size of the droplets of the liquid marking agent upon the transfer member 12 including the ink particles is substantially fixed by the development by development device 16 in one embodiment. Additional details regarding a development device 16 in one embodiment are described below with respect to FIG. 3. In one development embodiment, flux of negative charges generated by a charging device like a corona (e.g., reference 36 of FIG. 3 in one embodiment) are aimed towards liquid marking agent upon transfer member 12 which is grounded in one example. Consequently, the ink particles 28 become negatively charged and pulled toward the transfer member 12 due to the electrical field.

As mentioned above, one or more of the illustrated components of FIG. 1 may be omitted or implemented differently. The development device 16 may be utilized as a separate device in configurations of hard imaging device 10 which utilize liquid marking agents which do not include charge directors in one embodiment. In another embodiment, various components of FIG. 1 may be combined. For example, in one embodiment, development device 16 may be omitted or combined into a component of the liquid removal system (e.g. roller 40 of FIG. 4 in one embodiment), for example, when a liquid marking agent which includes charge directors is used.

Liquid removal system 17 is downstream of the development device 16 and is configured to expose the liquid marking agent upon the transfer member 12 to one or more process conditions to remove at least a portion of the liquid carrier of the liquid marking agent deposited upon the transfer member 12 in one embodiment. In some embodiments, liquid removal system 17 may include one or more devices capable of removing the liquid carrier and may be implemented in various ways as discussed further below with respect to the examples of FIGS. 4-6. For example, in some configurations, liquid removal system 17 includes one or more physical (mechanical) removal devices 18 to physically or mechanically remove the liquid carrier and a drying device 20 configured to cause evaporation of remaining liquid carrier and to provide melting of resin to facilitate transfer to media 22 in one embodiment.

In some example embodiments, one or more physical removal devices 18 may be configured to expose the transfer member 12 to one or more process conditions to physically remove some of the liquid carrier. Examples of physical removal devices 18 for physically or mechanically removing some of the liquid carrier include rollers and/or air knives. The removed liquid carrier may be collected, filtered and recycled for subsequent use in at least one embodiment. In some additional embodiments, a plurality of stages of physical removal devices 18 may be used as described further below. In addition to embodiments of system 17 including one or more stages of physical removal devices 18, a drying device 20 may be provided in an additional stage of system 17 or may be the only device of the liquid system 17 in different embodiments. In some embodiments, physical removal of at least a portion of the liquid carrier by one or more devices 18 is beneficial to reduce power requirements of subsequent heating or drying process conditions to which the transfer member 12 may be exposed in some embodiments prior to transfer.

In example embodiments, drying device 20 may be used alone in the system 17 or in addition to physical removal devices 18 which are present in the system 17 to provide process conditions to remove the liquid carrier. Drying device 20 may be omitted in some embodiments.

Drying device 20 is configured to heat the liquid marking agent upon the transfer member 12 to remove the liquid carrier in one embodiment. In one embodiment, drying device 20 is configured to provide sufficient heat to evaporate some or all liquid carrier present upon the transfer member 12 and melt the resin of the ink particles (if present). In one embodiment, drying device 20 is configured to apply heat within a range of approximately 80-120 degrees C. to the transfer member 12. Drying device 20 may comprise one or more IR lamps over one or more of the surfaces of transfer member 12 or may be configured to blow heated air over one or more of the surfaces of the transfer member 12 in example arrangements. High speed air (e.g., 25-200 m/s) may be used and may include turbulent air for increased efficiency. In addition, the transfer member 12 may be heated and/or one or both sides of the media may be heated prior to or during transfer in some embodiments. In some embodiments, the liquid removal system 17 may only include one or more drying devices 20 and devices 18 may be omitted.

Following drying at the drying device 20, the ink particles are transferred from the transfer member 12 to media 22 at a transfer station 23 to form a hard version of the image using the media 22. Transfer station 23 may use heat, electrical charge and/or pressure to assist with the transfer of the ink particles to the media 22 in illustrative examples. A counter roller 25 is provided in one embodiment to assist with transfer of the image to the media 22. In one embodiment, counter roller 25 provides relatively high pressure (e.g., 100 g/mm$^2$) to assist with the transfer of the images. Example types of media 22 include sheet media, roll media, or any other suitable print or copy substrate. Resin in the liquid marking agent as free floating particles or encapsulated about the ink particles assists with adhesion of the ink particles to the media 22.

The arrangement of FIG. 1 may also include an application apparatus 33 (e.g., one or more analog roller) intermediate the transfer station 23 and print head 14 in some embodiments. In one embodiment, the application apparatus 33 is configured to provide additive material (discussed further below with respect to the example of FIG. 10) upon the surface of the transfer member 12 which is to subsequently receive the droplets of the liquid marking agent from the print device 14.

Figure 2:
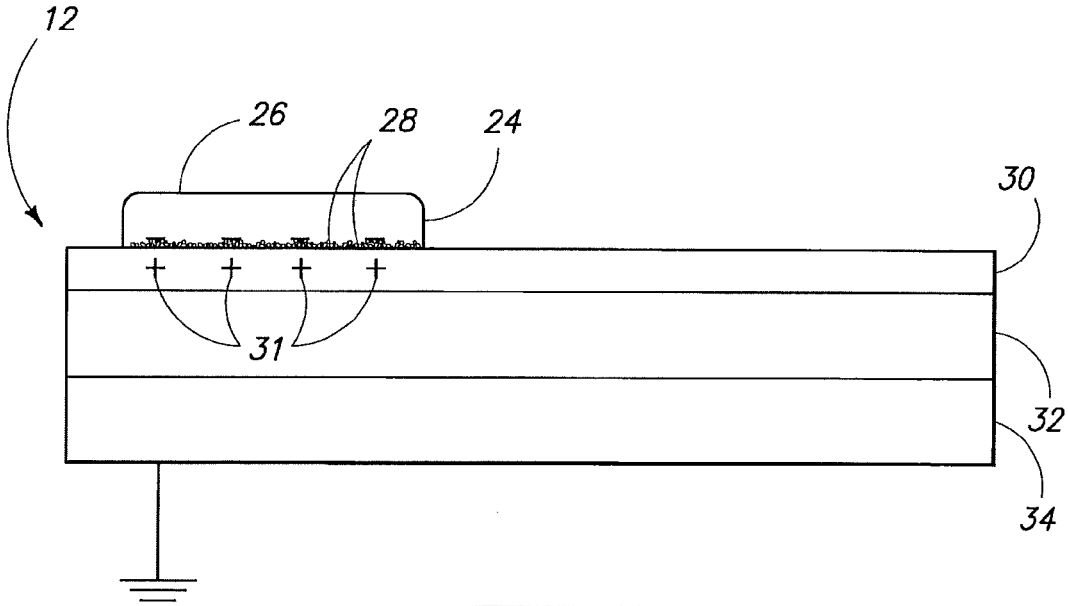
FIG. 2 is an illustrative representation of a transfer member according to one embodiment.

Referring to FIG. 2, additional details of one embodiment of transfer member 12 are shown and which may be provided as a belt or a surface of a drum. The transfer member 12 comprises a plurality of layers in the illustrated configuration. A droplet 24 of a liquid marking agent is shown upon the transfer member 12. One or more of the layers are electrically conductive in one embodiment. In the specific example embodiment shown in FIG. 2, transfer member 12 includes three layers comprising a release layer 30, a soft layer 32 and a base layer 34. In one embodiment, the soft layer 32 is configured to provide a relatively fast response time (resistive and capacitive) on the order of 1 ms (i.e., the time for positive charges to migrate upward through the layer—if negative charging of ink particles is used) compared with the configuration of the release layer 30 which has a higher resistivity and slower response time of approximately 100-200 ms in one embodiment. The above-described arrangement of transfer member 12 allows positive counter charges 31 (e.g., which may result from charging by development device 16) to stick near the upper surface of the transfer member 12 while also being adequately erased prior to the deposition of the marking agent of the next image upon the transfer member 12. Parameters of the transfer member 12 and/or heating of the transfer member 12 may be tailored to specific applications to alter conductivities of one or more layers of the transfer member 12 to provide desired image retention or erasure characteristics.

In one embodiment, the release layer 30 is non-swelling and has a resistivity of approximately $10^{12}$ Ohm-cm. The release layer 30 is configured to resist absorption of the liquid carrier of the marking agent while facilitating release of the ink particles of the marking agent to media 22 in one embodiment. Release layer 30 comprises a fluorosilicone rubber substrate having a thickness of approximately 5 microns in one embodiment.

In one embodiment, the soft layer 32 is compliant and has a resistivity of approximately $10^9$ Ohm-cm. The soft layer 32 comprises conductive rubber and has a thickness of approximately 40-100 microns in one embodiment.

In one embodiment, the base layer 34 may be grounded and be a source of positive counter charges 31. In one embodiment, the base layer 34 is electrically conductive (e.g., $10^{-2}$ Ohm-cm) but in other embodiments can have much lower conductivity (e.g., $10^9$ Ohm-cm) and may be embodied as an electrically conductive polyimide in one possible configuration (e.g., carbon in Kapton® polyimide film available from E. I. du Pont de Nemours and Company). Base layer 34 has a thickness of approximately 40-100 microns in one embodiment.

Figure 3:
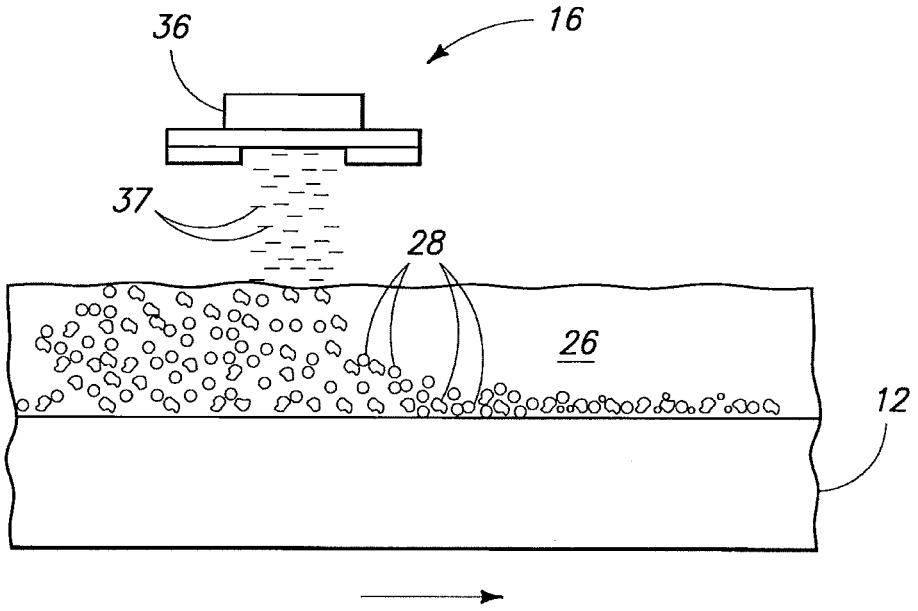
FIG. 3 is an illustrative representation of electrically charging a liquid marking agent according to one embodiment.
Figures 11A, 11B, 11C:
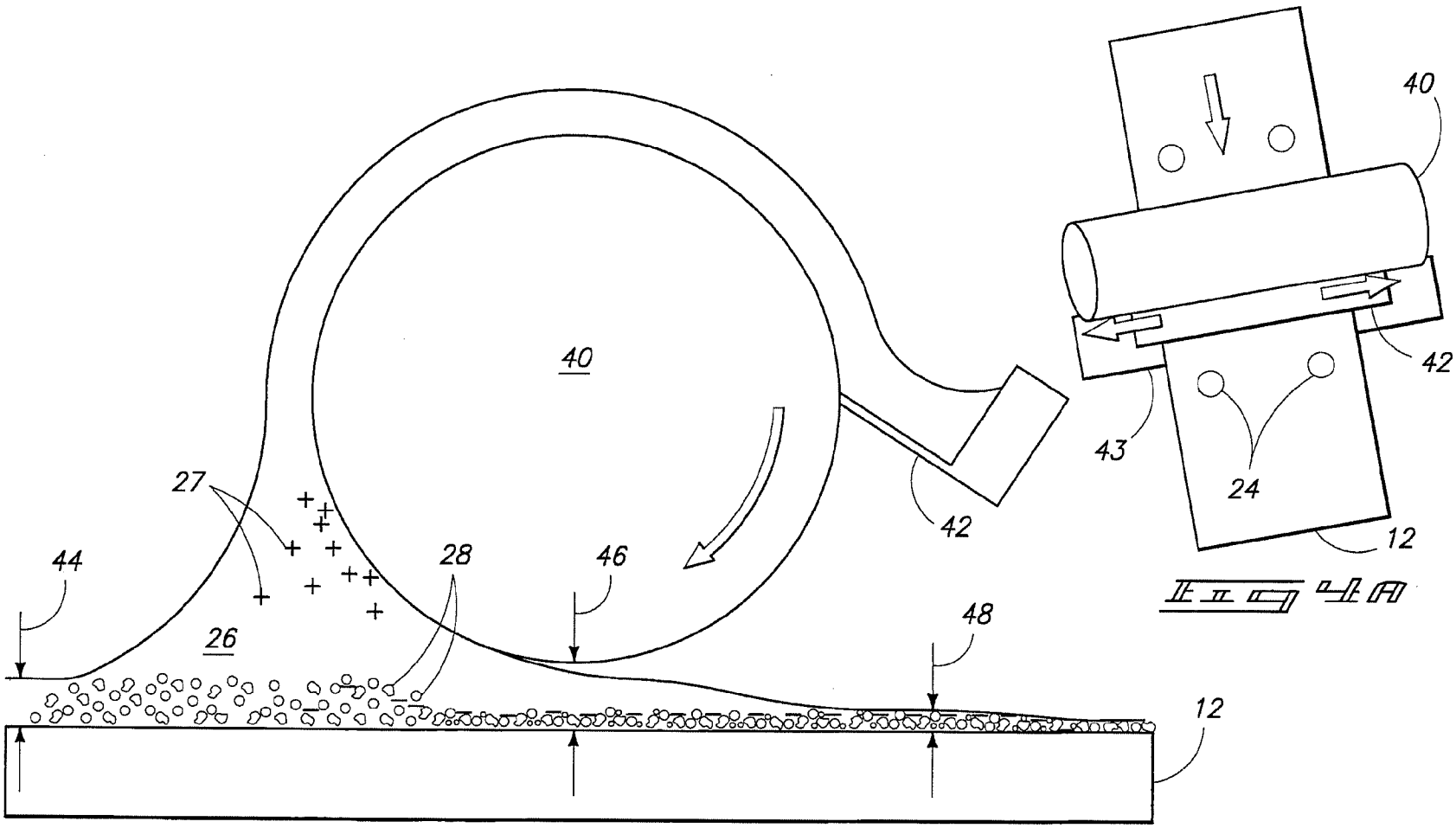
Figure 11B:
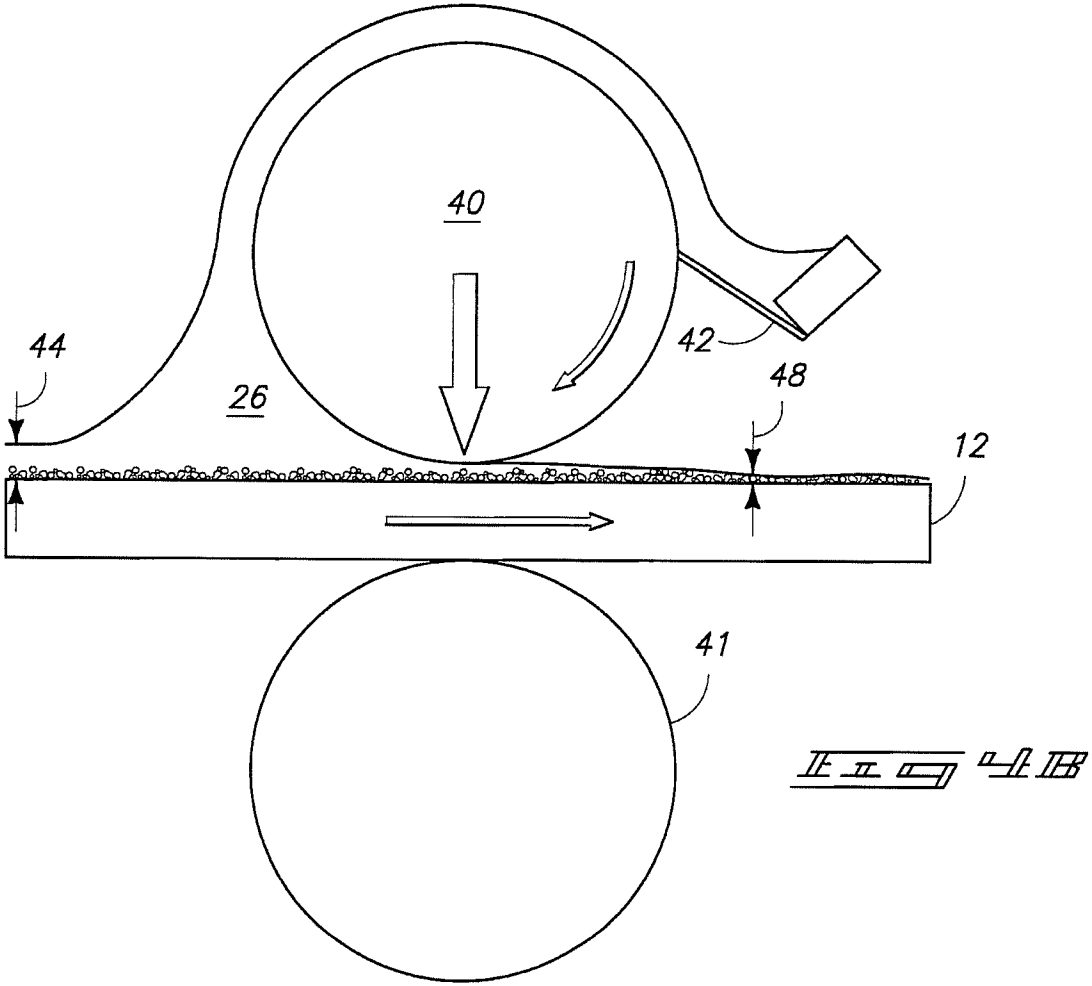

Referring to FIG. 3, one embodiment of development device 16 is shown. Other configurations of development device 16 are possible. Development device 16 is configured to charge the ink particles upon the transfer member 12 via an electrical field or via ion/electron flux in some implementations. In one embodiment, the development device 16 is embodied as a corona 36 and the liquid marking agent upon the transfer assembly 12 is bombarded with electrons 37 which operate to electrically compact or compress the charged ink particles 28 within the liquid carrier 26 upon the transfer member 12 as shown. In one embodiment, the development device 16 is used with arrangements of hard imaging device 10 which utilize the liquid marking agent which is substantially free of charge directors. Various embodiments are described below with respect to FIGS. 4-5B for removing liquid carrier 26. In the below-described embodiments, the development device 16 may be used to provide compacting of the ink particles 28 prior to removal of the liquid carrier by the arrangements of FIGS. 4A-5B. Other embodiments and combinations of the components are possible.

Referring to FIG. 4, one embodiment of a liquid removal system 17 is shown. The embodiment depicted in FIG. 4 is arranged for use with arrangements of hard imaging device 10 which utilize liquid marking agents which include charge directors 27. The depicted liquid removal system 17 includes a physical removal arrangement including a roller 40 and a blade 42 in the depicted embodiment. Roller 40 and blade 42 may be implemented as a metal roller and metal blade, respectively, in one embodiment. Roller 40 is configured to rotate in a clockwise direction which is reverse or opposite to the direction of travel of the transfer member 12 in one embodiment. In one embodiment, the roller 40 may rotate at a velocity within a range of 0.5 to two times the process velocity of the transfer substrate 12 where the shear velocity is equal to the process velocity of the transfer substrate 12 plus the rotational surface velocity of the roller 40. During operation, the liquid carrier 26 upon the transfer member 12 is pulled in the clockwise direction of rotation of the roller 40 and removed and collected by blade 42.

In one embodiment, roller 40 is spaced from transfer member 12 by a distance 46 (e.g., approximately 20 microns) which is greater than a thickness 44 of the liquid carrier 26 (e.g., 10 microns) deposited upon the transfer member 12. The roller 40 may be biased at approximately −500 V DC which operates to attract the positively charged charge directors 27 which assists with attracting the liquid carrier 26 upwardly and about the roller 40 for removal by the blade 42 which is positioned stationary with respect to roller 40 in one embodiment. In one embodiment, the liquid carrier 26 has a thickness 48 of approximately 2 microns following passage thereof below the roller 40. Biasing of roller 40 operates to develop (e.g., compact or compress) the ink particles 28 upon the transfer member 12 as shown in FIG. 4 and the roller 40 may also be referred to as a development device. In addition, the development device 16 of FIG. 1 may be omitted in some embodiments which use an electrically biased roller 40.

Referring to FIG. 4A, in the illustrated embodiment, a catch tray 43 is shown below metal blade 42. Metal blade 42 may be sloped in a manner to direct liquid carrier 26 received from the transfer member 12 around the media 22 to the catch dray 43 for disposal, recycling, reuse, etc.

Referring to FIG. 4B, another embodiment of a liquid removal system 17 is shown. The embodiment depicted in FIG. 4B is arranged for use in one implementation with liquid marking agents which do not include charge directors 27. In FIG. 4B, roller 40 is not electrically biased but is positioned to contact the transfer member 12 with relatively weak pressure (e.g., 1 g/mm$^2$) in one embodiment. A counter pressure roller 41 may be positioned opposite to roller 40. The roller 40 rotates in a clockwise direction to transport liquid carrier 26 from transfer member 12 to metal blade 42. In one example, the liquid carrier 26 has a thickness 44 of approximately 10 microns prior to passage of the transfer member 12 adjacent to the liquid removal system of FIG. 4B and a thickness 48 of approximately 1 micron after exit of the liquid removal system 17. In one embodiment, heavy oils may be added to the liquid marking agent to protect the surface of the transfer member 12. Example heavy oils which may be used include Marcol available from Exxon-Mobil Corporation or other oils described in the '141 patent incorporated by reference above.

In one embodiment, roller 40 (e.g., FIG. 4B) may be implemented as a squeegee configured to rotate in the same direction as the movement of transfer member 12 to remove excess liquid carrier 26. The squeegee may contact the transfer member 12 in one arrangement. If the ink particles 28 are electrically charged, the squeegee may be electrically biased in one embodiment with the same polarity as the charge of the ink particles 28 to assist with the removal of the liquid carrier while leaving the ink particles 28 upon the transfer member 12. In one embodiment, charge directors of the opposite polarity may also be present in the liquid carrier to assist with removal of the liquid carrier by the squeegee. In addition, the squeegee may be arranged in a manner such that gravity assists with the recovery of the liquid carrier 26 for subsequent reuse in one embodiment. For example, the squeegee may be positioned below the transfer member 12 in one embodiment. In some embodiments, the transfer member 12 may be electrically charged. For example, the transfer member 12 may be biased at +300 V relative to an electrical bias of the squeegee roller in one embodiment to attract negatively-charged ink particles 28.

Referring to FIG. 4C, another embodiment of a liquid removal system 17 is shown. The embodiment depicted in FIG. 4C is arranged for use in one implementation with liquid marking agents which do not include charge directors 27. The embodiment of FIG. 4C is similar to the embodiment of FIG. 4 (without biasing of roller 40 in one embodiment) with the addition of an air knife 50 positioned adjacent to transfer member 12 in a manner to assist with removal of the liquid carrier 26 by roller 40. In one embodiment, air knife 50 emits a flow of air towards the liquid carrier 26 upon transfer member 12 and which operates to assist with liquid carrier 26 being transferred by the roller 40 to the metal blade 42. The liquid carrier 26 has thicknesses 44, 48 of approximately 10 and 2 microns, respectively, in one example, and roller 40 is spaced a distance 46 about 20 microns from transfer member 12 in one embodiment. In one embodiment, air knife 50 may be implemented as a super air knife configured to emit a stream of air at a rate of approximately hundreds of meters/second. Example super air knives are available from Exair.com. Other air knives described herein may also be implemented as super air knives in some embodiments.

Referring to FIG. 4D, another embodiment of a liquid removal system 17 is shown. The embodiment depicted in FIG. 4D is arranged for use in one implementation with liquid marking agents which do not include charge directors 27. In FIG. 4D, the roller 40 is spaced a distance 46 of approximately 10 microns and the liquid carrier 26 has thicknesses 44, 48 of approximately 10 and 2 microns, respectively, in the described example. The smaller distance 46 (e.g., compared with the embodiment of FIG. 4C) assists with removal of liquid carrier 26 by roller 40 in one embodiment.

Referring to FIG. 4E, yet another embodiment of a liquid removal system 17 is shown. The embodiment depicted in FIG. 4E is arranged for use in one implementation with liquid marking agents which do not include charge directors 27. The liquid carrier 26 has thicknesses 44, 48 of approximately 10 and 2 microns, respectively, in one example and roller 40 is spaced about 20 microns from transfer member 12 in one embodiment. In the example embodiment of FIG. 4E, additional liquid carrier (i.e., not ejected from the print device 14) may be added upon a portion of transfer member 12 at a location 29 prior to passage of the portion of the transfer member 12 beneath the roller 40.

Figure 5:
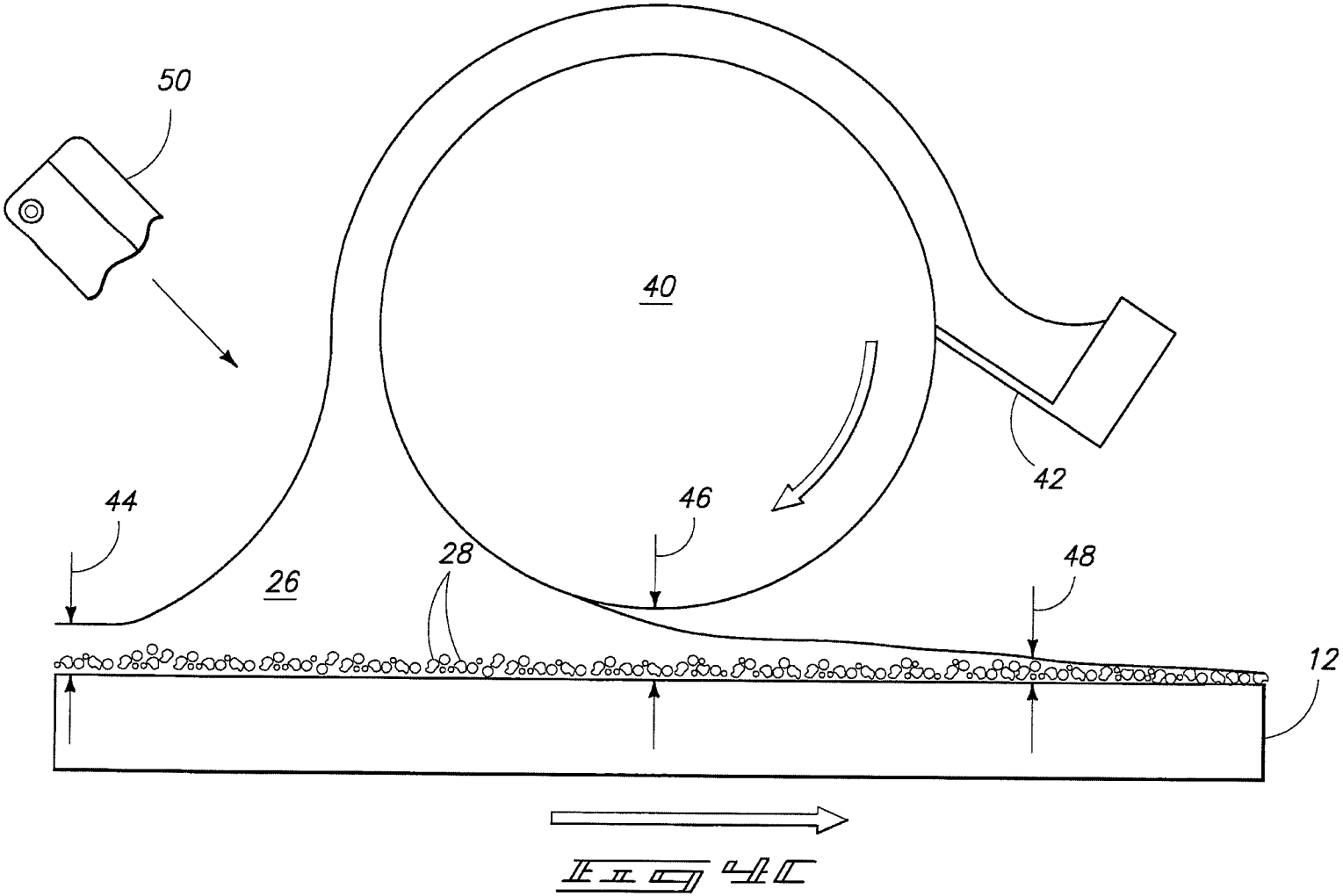
FIG. 5 is an illustrative representation of a liquid removal system according to one embodiment.
Figure 11:
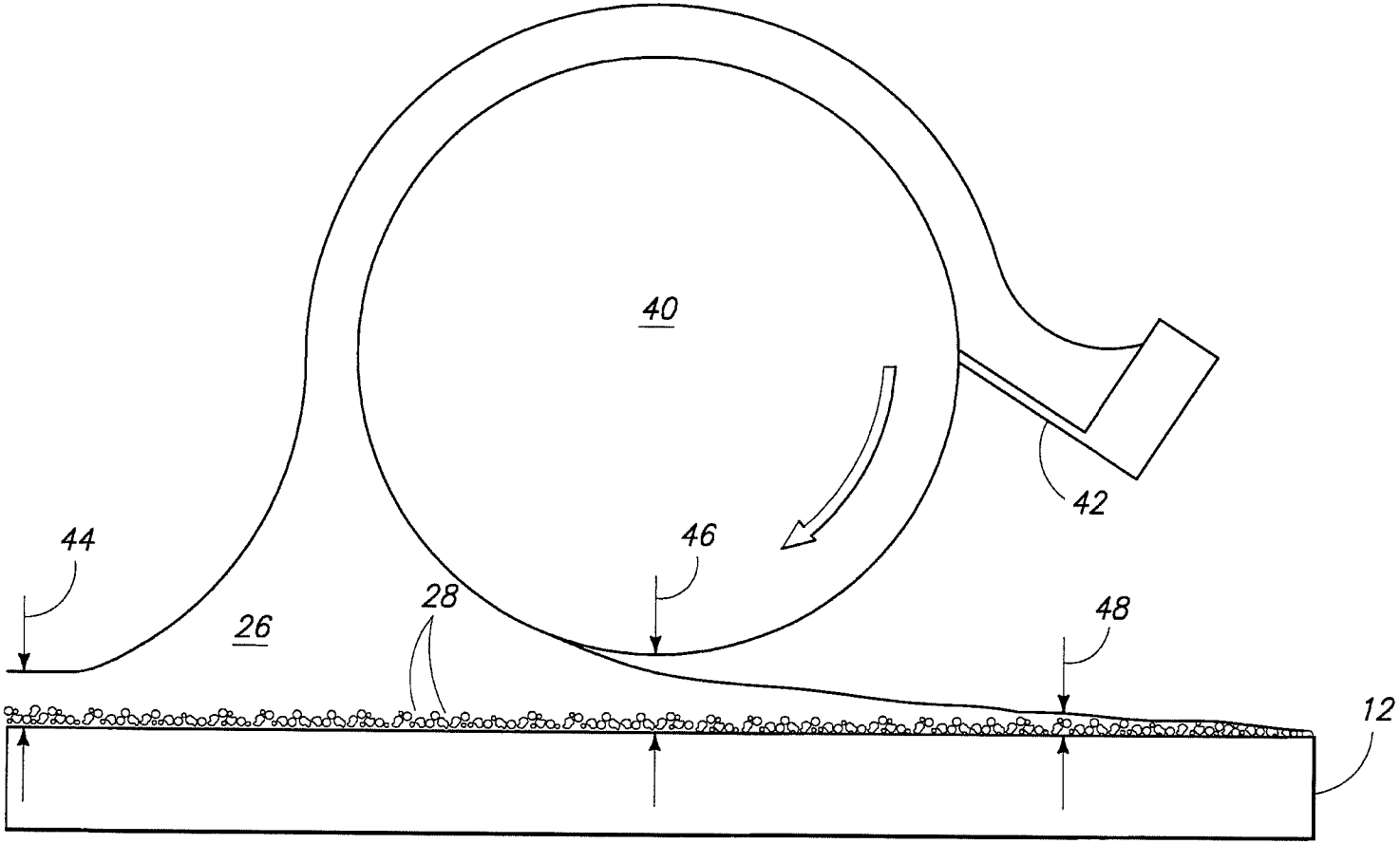
Figure 11:
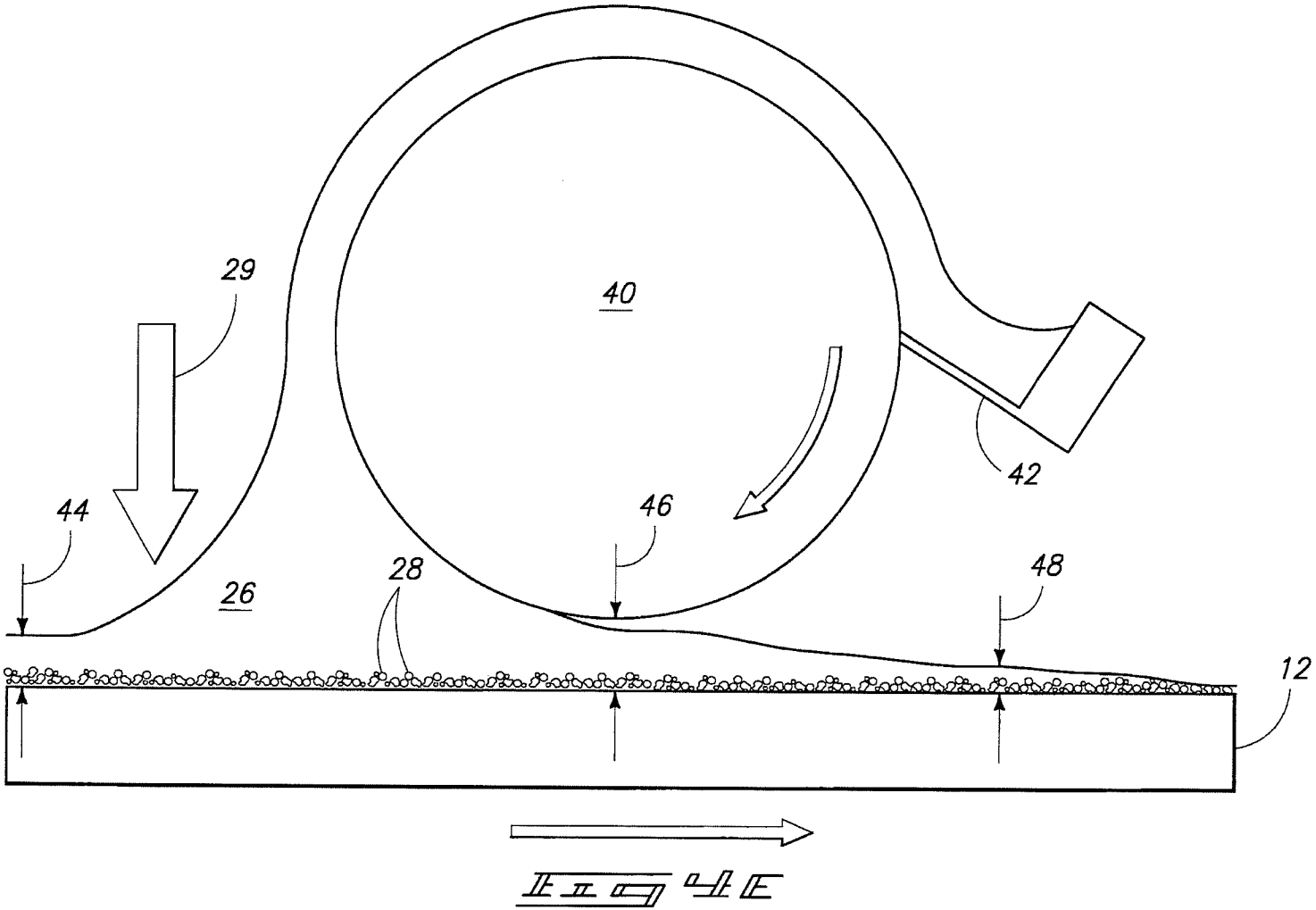
Figure 5:
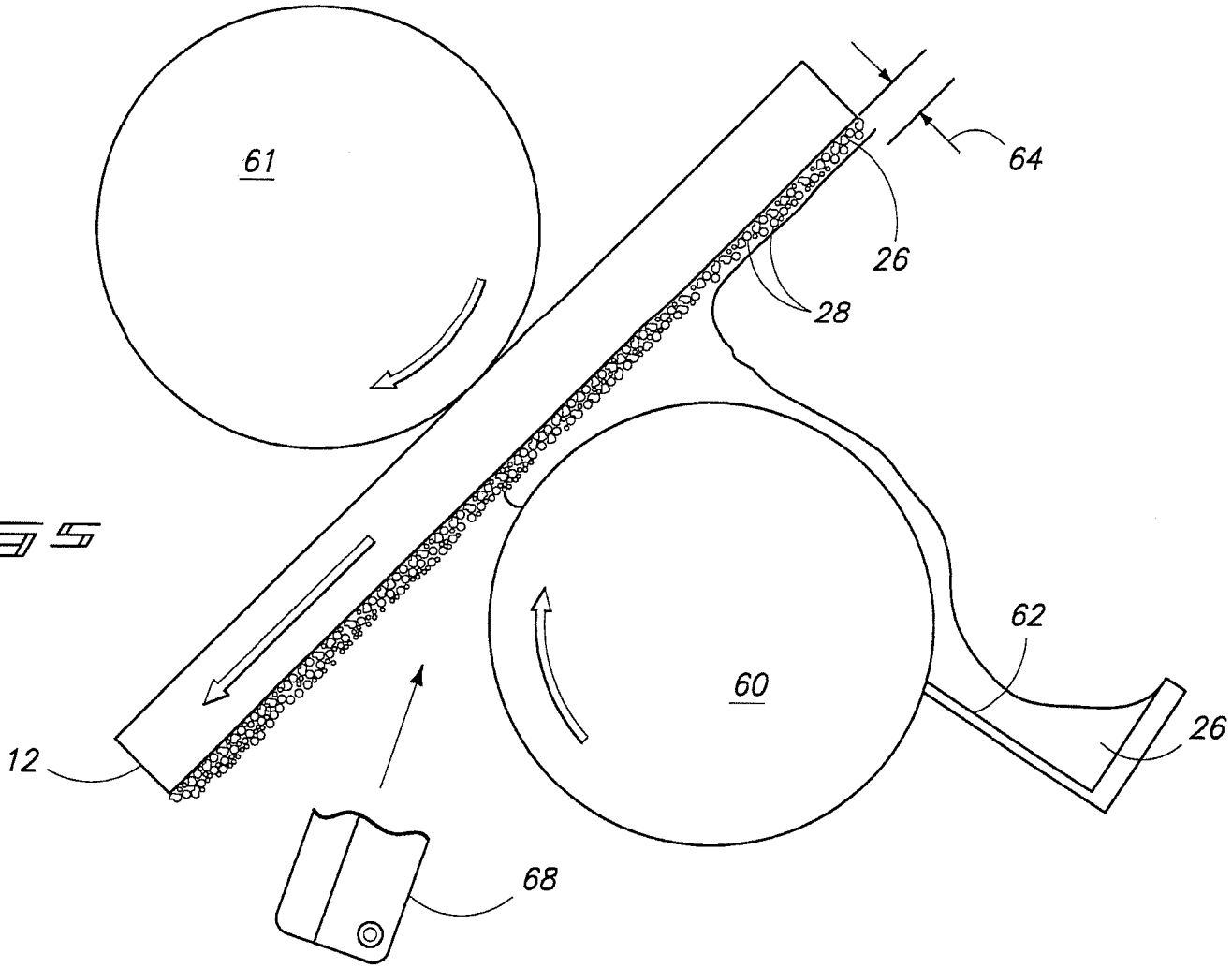

The development device may be embodied in the liquid removal system 17 (e.g., as discussed above with respect to FIG. 4) while the configurations of FIGS. 4A-4E may be used in conjunction with the separate development device 16 of FIG. 3. In addition, the example embodiments of FIGS. 4-4E may individually comprise an entirety of the liquid removal system 17 for some embodiments of hard imaging device 10. In other embodiments, the liquid removal system 17 may include alternate components or components in addition to the arrangements of FIGS. 4-4E. For example, the arrangements shown in FIGS. 5-5B may be used alone or in combination with the arrangements of FIGS. 4-4E. Accordingly, in some embodiments of liquid removal system 17, the structures of FIGS. 4-4E are not used and an appropriate structure shown in FIGS. 5-5B is used for removing liquid carrier. In liquid removal system 18 configurations which utilize components of both FIGS. 4-4E and 5-5B, the component(s) of FIGS. 4-4E may be referred to as a first or initial removal stage and the component(s) of FIGS. 5-5B may be referred to as a second or subsequent removal stage after the first removal stage. As discussed herein, the liquid removal system 18 may also comprise a drying device 20 in an additional stage. Furthermore, alternative arrangements of liquid removal systems 18 may be used in other embodiments.

Referring to FIG. 5, the transfer member 12 moves between opposing rollers 60, 61 of the liquid removal system 17. An air knife 68 is positioned to emit a stream of air towards a nip of rollers 60, 61. The emitted stream of air blows liquid carrier 26 from the surface of transfer member 12 and which is directed by roller 60 to a stationary blade 62 where the liquid carrier 26 may be collected, recycled, re-used, etc. The arrangement of FIG. 5 is configured to make use of gravity to remove and collect the liquid carrier 26 in one embodiment. For example, in the depicted embodiment, the liquid carrier 26 and ink particles 28 are provided upon a lower surface of transfer member 12 when transfer member 12 passes between rollers 60, 61 to facilitate collection of the liquid carrier 26 by the blade 62. In the illustrated example, the stream of air emitted from the air knife 68 blows the liquid carrier 26 backward and which is directed by the rotating roller 60 to the blade 62 where the liquid carrier 26 may be collected, and re-used. In the illustrated example, the gap 64 between the roller 60 and the surface of the transfer member 12 is about 20 microns, a thickness of the ink particles 28 is approximately 0.5 microns, and the liquid carrier 26 has a thickness of approximately 1-2 microns prior to removal of the liquid carrier 26. The use of the air knife 68 removes liquid carrier 26 or spreads the liquid carrier 26 on the surface of transfer member 12 which facilitates drying in the drying device 20 discussed below. In one embodiment, the roller 60 may be electrically biased to the same polarity as an electrical charge of the ink particles 28 to provide compression or compacting of the ink particles 28 upon the transfer member 12.

Figure 5A:
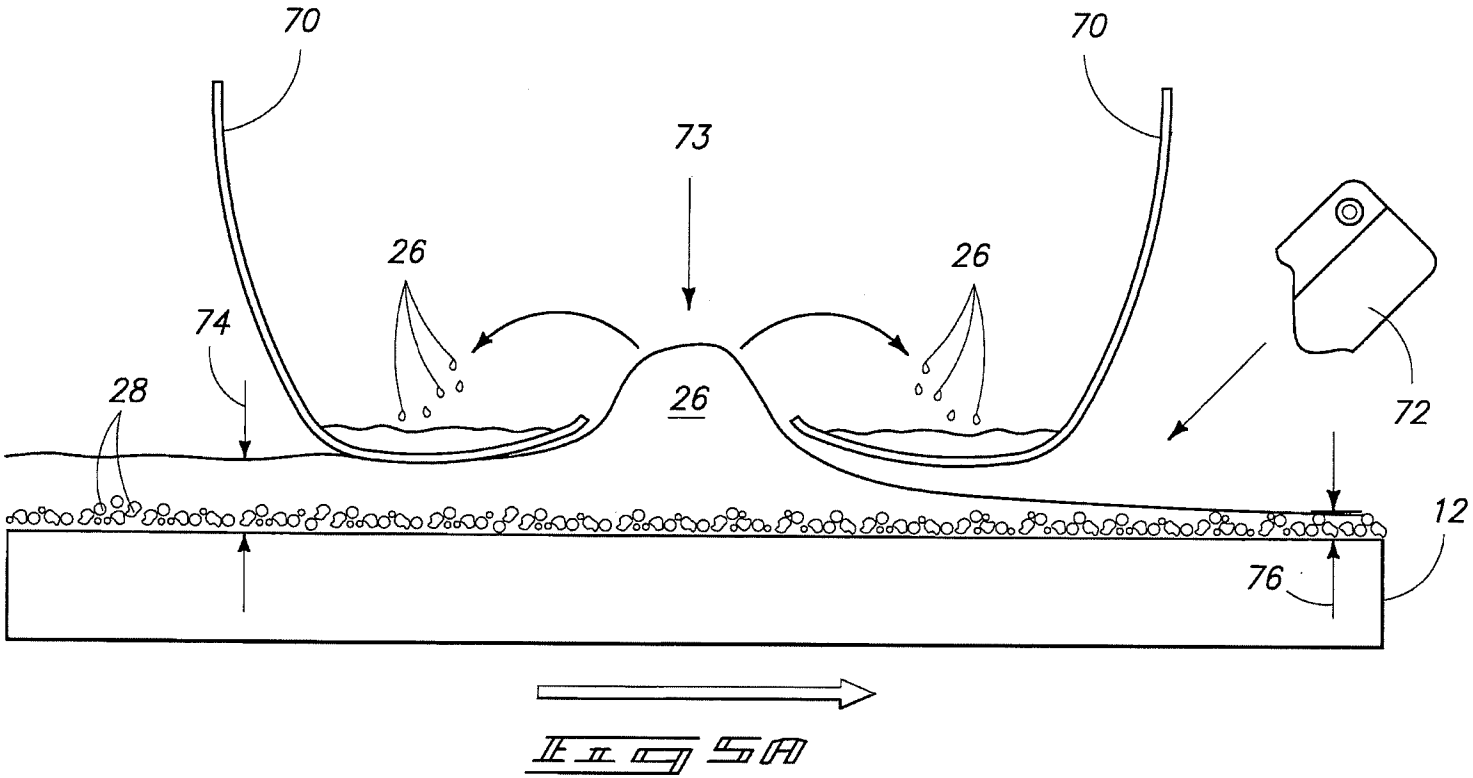
FIG. 5*a* is an illustrative representation of a liquid removal system according to one embodiment.
Figure 11B:
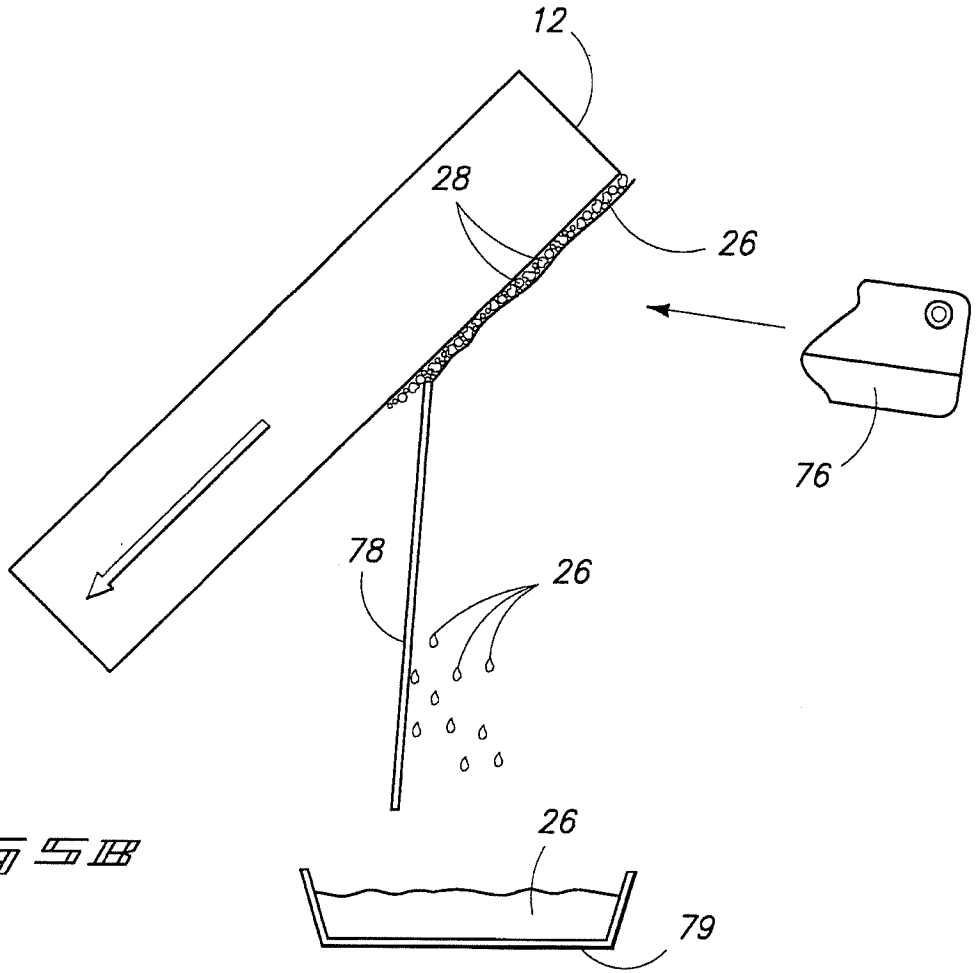

In the illustrated example embodiment of FIG. 5A, catch trays 70 may be positioned elevationally over the moving transfer member 12. An air knife 72 is arranged to emit a stream of air downwardly towards the transfer member 12. The emitted air blows liquid carrier 26 from the transfer member 12 through an opening 73 into the catch trays 70. The liquid carrier 26 received in the catch trays 70 may be collected, recycled, reused, etc. The arrangement of FIG. 5A may operate to provide a layer of the liquid carrier 26 having a thickness 76 of approximately 1 micron from a layer having a thickness 74 of approximately 10 microns.

Referring to FIG. 5B, another example liquid removal system 17 is shown. The depicted example configuration includes an air knife 76, a soft blade 78 comprising urethane, Teflon, etc. and a reservoir 79. The blade 76 is oriented to extend upward in a manner almost to the surface of the transfer member 12 and in one embodiment may contact the ink particles 28 upon the transfer member 12. The arrangement of FIG. 5B is configured to make use of gravity to remove and collect the liquid carrier 26 in one embodiment where the liquid carrier 26 is provided upon a lower surface of transfer member 12. In the illustrated example, the stream of air emitted from the air knife 76 blows the liquid carrier 26 off of the surface of the transfer member 12 and which lands upon or is directed to the blade 78 and reservoir 79 where the liquid carrier 26 may be collected and reused in one embodiment.

Figure 6:
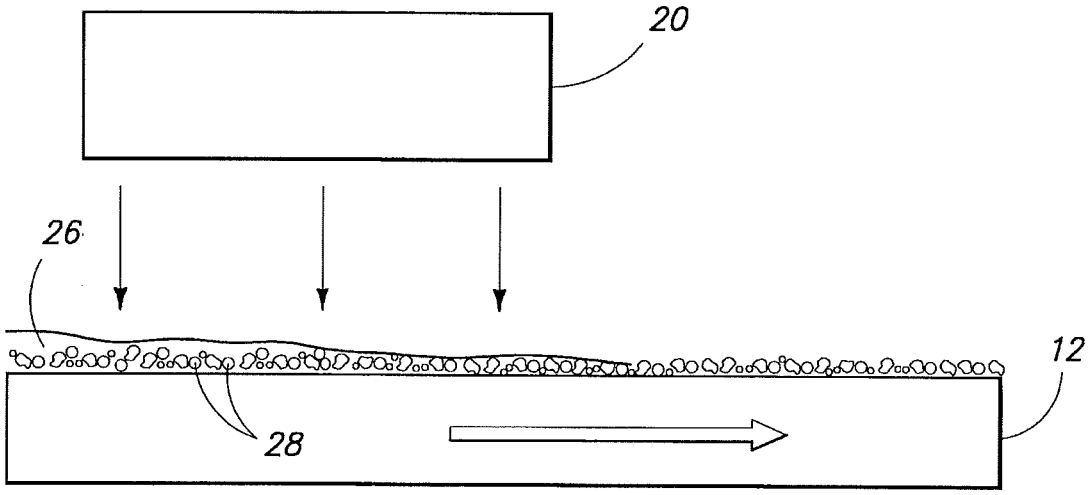
FIG. 6 is an illustrative representation of a liquid removal system according to one embodiment.

Following passage of the transfer member 12 by one or plural ones of the above-described stages, the transfer member 12 is directed to another stage including drying device 20 of the liquid removal system 17 and as shown in one embodiment in FIG. 6. The drying device 20 may include one or more device in the form of a fan configured to direct heated air to the surface of the transfer member, an IR lamp, or other appropriate heating element. In one embodiment, drying device 20 provides sufficient heat to evaporate liquid carrier 26 which may remain upon the transfer member 12 and melt the resin of the ink particles (if such resin is present). Evaporated liquid carrier 26 may be condensed and re-used in one embodiment.

Following exposure to the heat at the drying device 20, the transfer member 12 is directed to the transfer station 23 where the ink particles 28 upon the transfer member 12 (which may be referred to as a fused ink layer of the image) are transferred to the media 22 providing an offset printing arrangement in one embodiment. Transfer station 23 may use one or more of heat, pressure or electrical charge to assist with the transfer of the ink particles 28 from the transfer member 12 to the media 22. As mentioned above, the transfer member 12 may be electrically biased. For example, the transfer member 12 may be biased at −300 V relative to the media 22 in one embodiment to push negatively-charged ink particles towards the media 22 during transfer operations.

Figure 7:
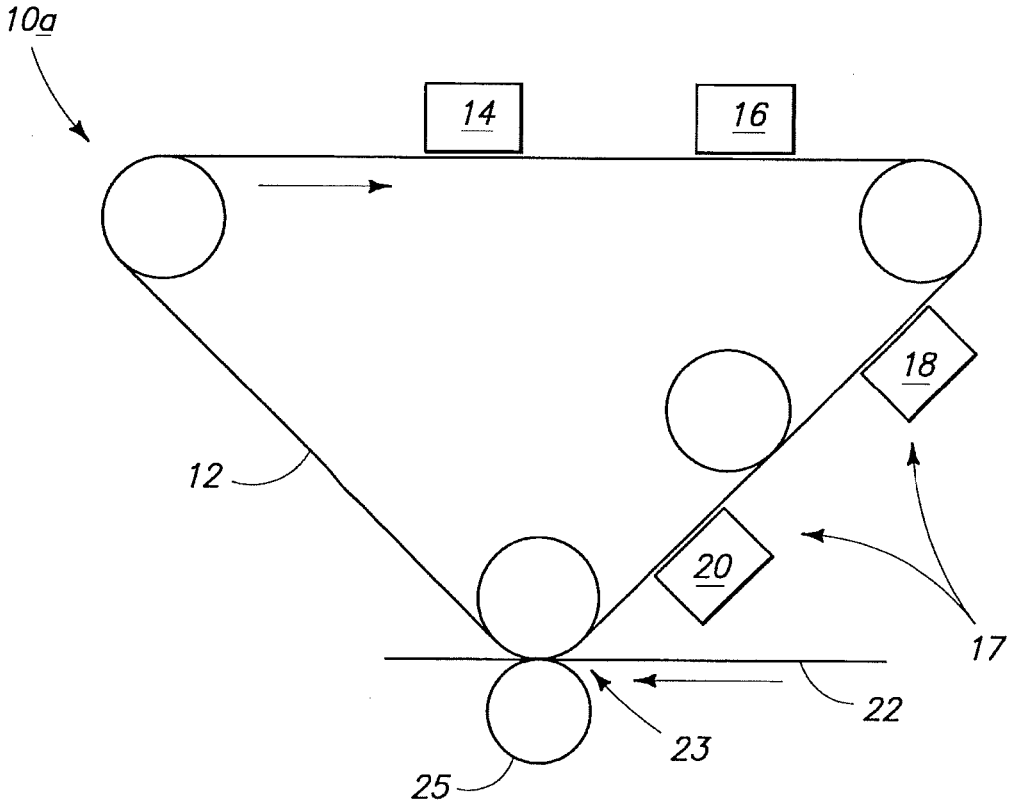
FIG. 7 is an illustrative representation of a hard imaging device according to one embodiment.

Alternative arrangements of hard imaging device 10 are possible. For example, referring to FIG. 7, an alternative embodiment of the hard imaging device is depicted with respect to reference 10*a*. In the illustrated embodiment of FIG. 7, the liquid removal system 17 is positioned to take advantage of gravity in liquid carrier removal/drying operations. For example, the arrangement of FIG. 7 takes advantage of gravity to assist with removal of liquid carrier 26 deposited upon the transfer member 12 for example as discussed above with respect to FIGS. 5 and 5B.

Figure 8:
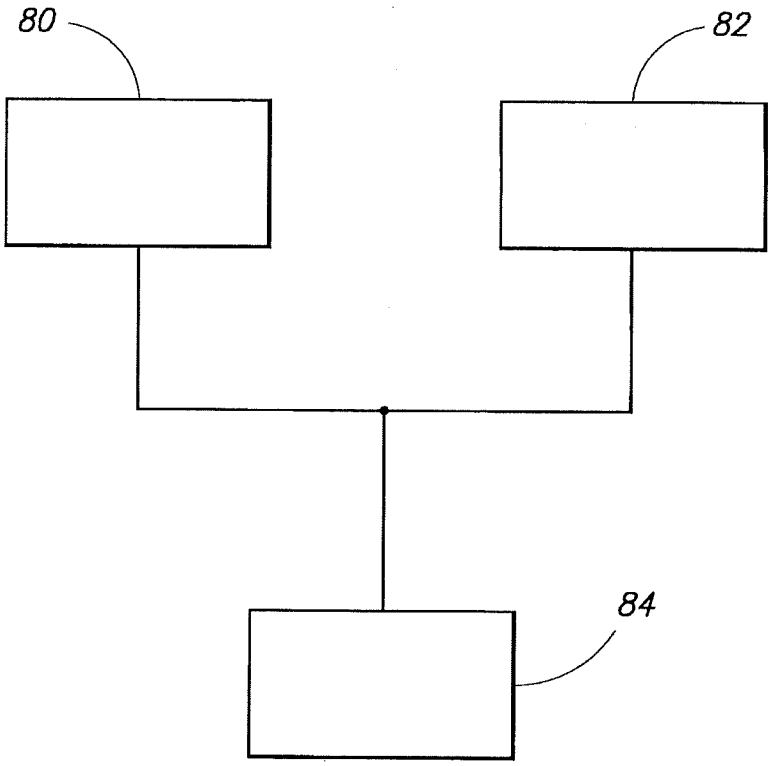
FIG. 8 is a block diagram of electrical components of a hard imaging device according to one embodiment.

Referring to FIG. 8, an example arrangement of some electrical components of hard imaging device 10 is illustrated according to one embodiment. The electrical components include a communications interface 80, control device 82, and storage circuitry 84 in one embodiment of hard imaging device 10. More, less or alternative components are provided in other embodiments of hard imaging device 10.

Communications interface 80 is arranged to implement communications of hard imaging device 10 with respect to external devices (not shown). For example, communications interface 80 may be arranged to communicate information bi-directionally with respect to device 10. Communications interface 80 may be implemented as a network interface card (NIC), serial or parallel connection, USB port, Firewire interface, flash memory interface, floppy disk drive, or any other suitable arrangement for communicating with respect to device 10. In one example, image data of hard images to be formed may be received within the device 10 by communications interface 80.

In one embodiment, control device 82 is arranged to access image data of images to be formed, process data, control data access and storage, issue commands, and control other operations of device 10 with respect to imaging. More specifically, control device 82 may access image data and control print device 14 to eject droplets of liquid marking agent at a plurality of selected locations (e.g., corresponding to pixels) and corresponding to images to be formed as specified by the image data. In one embodiment, control device 82 may comprise processing circuitry configured to implement desired programming provided by appropriate media in at least one embodiment. For example, the processing circuitry may be implemented as one or more of a processor and/or other structure configured to execute executable instructions including, for example, software and/or firmware instructions, and/or hardware circuitry. Exemplary embodiments of processing circuitry include hardware logic, PGA, FPGA, ASIC, state machines, and/or other structures alone or in combination with a processor. These examples of the control device 82 are for illustration and other configurations are possible.

The storage circuitry 84 is configured to store programming such as executable code or instructions (e.g., software and/or firmware), electronic data, databases, image data, or other digital information and may include processor-usable media. Processor-usable media may be embodied in any computer program product(s) or article of manufacture(s) which can contain, store, or maintain programming, data and/or digital information for use by or in connection with an instruction execution system including processing circuitry in the exemplary embodiment. Examples of storage circuitry 84 include memory, a hard disk or other types of suitable storage.

The roller 40 described above with respect to FIGS. 4-4E may be used in some embodiments to remove approximately 8 microns of liquid carrier (or more) at relatively high speeds of movement of the transfer member 12 (e.g., approximately 2 m/s). For example, a 10 micron layer of liquid carrier (or more), including 5% solids (a solids thickness of approximately 0.5 microns) may be reduced to approximately 2 microns in the above-described example embodiments. It is believed that power savings may be provided by the use of the initial devices 16 of the liquid removal system 17 prior to the drying device 20 inasmuch as drying is relatively inefficient (especially at relatively fast process speeds) and the liquid removal system 17 upstream of the drying device 20 reduces the amount of power needed to remove the liquid carrier in the drying device 20. It is estimated that the use of the initial devices 16 of the liquid removal system 17 reduces the power requirements (approximately five times) of the drying device 20 of the liquid removal system 17 compared with use of device 20 alone to remove the liquid carrier prior to transfer of the ink particles to the media.

Furthermore, referring to Table 1, an estimation of drying energy needed for inkjet systems which use a non-aqueous (e.g., solvent or oil-based) liquid marking agent versus a water based liquid marking agent is shown. It is believed that the use of a non-aqueous liquid carrier in the liquid marking agent saves approximately six times the power requirements due to ease of evaporation compared with the power needed for removing a similar amount of a water based carrier. Accordingly, it is believed that at least some arrangements of the disclosure may provide power savings of approximately 30 times compared with other inkjet configurations.

TABLE 1

| | Isopar L | Water | Ratio |
|---|---|---|---|
| Specific Heat J/(gr*K) | 2.3 | 4.2 | 1.8 |
| Heat of vaporation [J/g] | 280 | 2268 | 8.1 |
| Heating 1 g to 100deg [joul] | 184 | 336 | 1.8 |
| Total energy to evaporate 1 g [joul] | 464 | 2604 | 5.6 |

In addition, the droplets of liquid marking agent ejected from the print device 14 are provided upon the release layer 30 comprising a non-swelling layer in one disclosed embodiment in contrast to other inkjet printing systems which print directly upon media and additional drying is therefore needed to dry swelled water out of the media and against capillary forces of the media. It is believed that the power savings of embodiments described herein compared with other arrangements permits the disclosed arrangements to be competitively used in commercial arrangements and at commercial printing speeds.

Furthermore, some inkjet arrangements are used with a relatively limited number of types of media due to a need in such arrangements to swell some of the liquids into the media. The offset arrangement of some example embodiments of the disclosure including the use of the transfer member 12 expands the gamut of media which may be used in some inkjet applications. For example, many commercial applications utilize glossy or coated media which may be used with the apparatus and methods of at least some embodiments of the disclosure. In addition, since at least some of the processing occurs on the transfer member 12 (e.g., development, liquid carrier removal) as opposed to upon the media in some embodiments, additional media, such as PVC and plastics may be printed upon, for example, in industrial applications which may be otherwise unsuitable because of heat used in such other embodiments.

Figure 9:
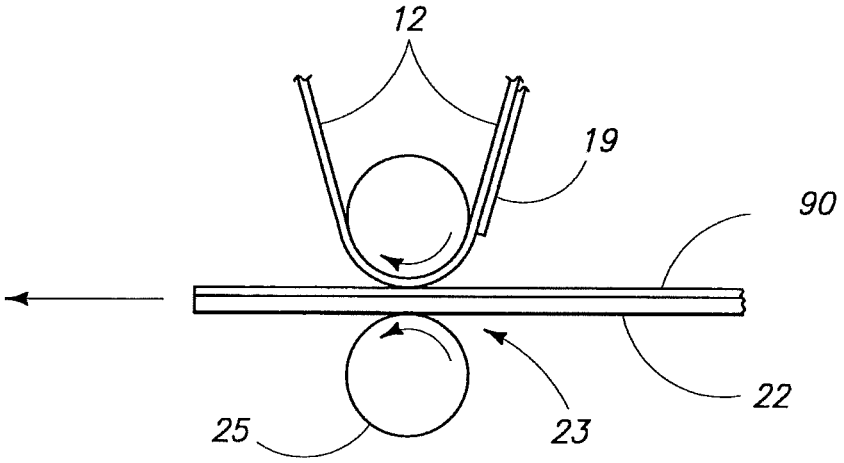
FIG. 9 is an illustrative representation of a transfer station according to one embodiment.

Referring to FIG. 9, one example embodiment of a transfer station 23 is shown. One or more of heat, pressure and an electrical charge may be used to facilitate transfer of an image 19 (e.g., ink particles 28) from transfer member 12 to media 22. In the depicted embodiment, the image receiving surface of the media 22 includes an additive material 90. In one embodiment, the additive material 90 such as the above-described resin is provided as a relatively thin layer (e.g., 20 nm-2000 nm) upon an image receiving surface of media 22. One or more analog rollers (not shown) may be positioned upstream of transfer station 23 along the media delivery path to provide the additive material 90 upon the media 22 prior to transfer of the ink of the image 19 to the media 22. Any suitable method or apparatus to provide the additive material 90 upon media 22 may be used. In one embodiment, the additive material 90 may be heated prior to transfer of the image at the transfer station 23 to assist with transfer of the ink of the image 19 to the media 22. Additive material 90 assists with adhering of the ink to media 22 and reduces penetration of ink particles into fibers of media 22.

Figure 10:
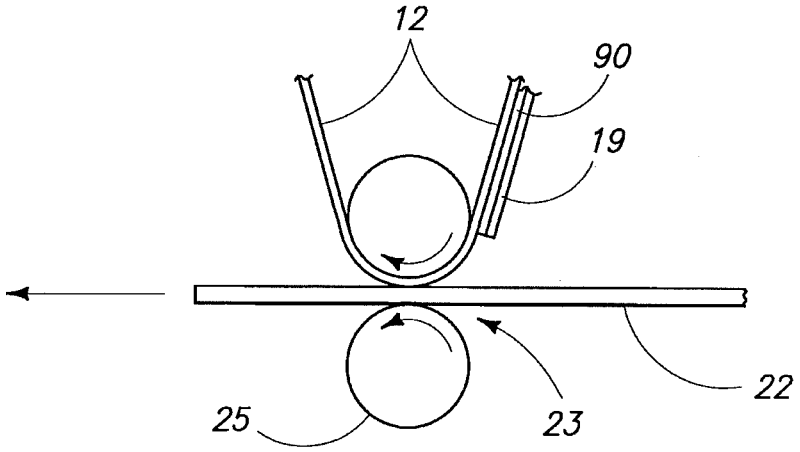
FIG. 10 is an illustrative representation of a transfer station according to one embodiment.

Referring to FIG. 10, another embodiment of transfer operations is described. In FIG. 10, additive material 90 is provided upon the transfer member 12 prior to reception of droplets of the liquid marking agent, and accordingly, droplets ejected from print device 14 are received upon the additive material 90 upon the transfer member 12. In example embodiments, the additive material 90 may be provided by one or more analog rollers (see FIG. 1) upon transfer member 12 at a location intermediate transfer station 23 and print device 14. Other deposition apparatus or methods may be used.

In some embodiments, the additive material 90 is provided in a continuous layer upon an entirety of the surface of the transfer member 12, or alternatively as a layer only upon portions of the transfer member 12 which receive the image 19 (as shown in FIG. 10). A layer of additive material 90 having a thickness of 0.5-1 microns may be used in some embodiments. Transfer station 23 transfers both the additive material 90 and image 19 to the media 22 and the additive material 90 may operate as a protective outer layer over the image 19 upon the media 22 following the transfer in one embodiment. The additive material 90 may be heated upstream of transfer station 23 prior to transfer in one embodiment to assist with the transfer of both the additive material 90 and the image 19 to the media 22. The resin may be omitted from the liquid marking agent in, for example, implementations of FIGS. 9 and 10 which provide additive material 90 comprising the resin upon the media 22 or transfer member 12. In other embodiments, the resin may be provided in the liquid marking agent as well as upon the transfer member 12 and/or media 22.

At least some advantages of some embodiments which provide jetting of liquid marking agent upon the transfer member 12 instead of media 22 include reducing strikethroughs, cockle and/or media expansion. In addition, a distance between the printhead and transfer substrate may be reduced compared with a distance between the printhead and media which provides increased print quality.

The protection sought is not to be limited to the disclosed embodiments, which are given by way of example only, but instead is to be limited only by the scope of the appended claims.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

What is claimed is:

1. An imaging method comprising:

supplying an additive resin material onto a media;

receiving a plurality of droplets of a liquid marking agent from a printer onto a transfer member, the droplets of the liquid marking agent individually comprising a plurality of ink particles suspended in a liquid carrier;

after the supplying and separately from the supplying, first heating the additive resin material on the media; and after the supplying and after the first heating, using the heated additive resin material on the media to facilitate transferring at least the ink particles from the transfer member to the media to form a hard version of an image using the media.

2. The method of claim 1, wherein after the receiving, developing the droplets upon the transfer member to substantially fix areas of the droplets upon the transfer member.

3. The method of claim 2, wherein after the developing but prior to the transferring, exposing the droplets upon the transfer member to a process condition to remove at least some of the liquid carrier of the droplets upon the transfer member.

4. The method of claim 1, wherein transferring the ink particles includes facilitating the transfer via performing second heating of the additive resin material on the media during the transfer of the ink particles to the media.

5. The method of claim 4, wherein the first heating of the addictive resin material on the media is performed at least prior to contact between the transfer member and the media.

6. The method of claim 1 wherein the receiving comprises receiving the droplets of the liquid marking agent individually comprising the ink particles suspended in the liquid carrier comprising a non-aqueous carrier.

7. A method of performing hard imaging comprising:

printing a plurality of droplets of a liquid marking agent onto a transfer member, the droplets of the liquid marking agent individually comprising a plurality of ink particles within a non-aqueous carrier fluid, wherein at least some of the respective ink particles are coated by a first resin material and wherein the printed droplets correspond to an image to be formed;

transferring the ink particles and the first resin material of the droplets from the transfer member to media to form a hard version of the image using the media, including facilitating the transfer via heating a second additive resin material on the media; and providing the second additive resin material on the media prior to the transferring and performing the heating of the second additive resin material after providing the second additive resin material on the media and prior to the transferring.

8. The method of claim 7, comprising:

heating at least the first resin material at least one of:

prior to the transferring; and during the transferring.

9. The method of claim 7 further comprising, after the printing but prior to the transferring, developing the droplets of the liquid marking agent upon the transfer member to substantially fix areas of the droplets upon the transfer member.

10. A hard imaging device comprising:

a print device to print a plurality of droplets of a liquid marking agent onto a media, the droplets of the liquid marking agent individually comprising a plurality of ink particles within a non-aqueous carrier fluid, wherein the ejected droplets correspond to an image to be formed;

a transfer member adjacent to the print device and configured to receive the printed droplets of the liquid marking agent , wherein the transfer member is configured to transfer the ink particles from the transfer member to media to form a hard version of the image;

a first supply device to supply a first meltable additive resin material onto the media to carry the meltable additive resin material to facilitate transfer of the ink particles to the media, wherein the supply device is positioned along a media delivery path prior to a location of the transfer of the ink particles; and a transfer station configured to transfer, in cooperation with the transfer member, the ink Particles to the media, wherein the media, including the first meltable additive resin material thereon, is heated along the media delivery path after the first supply device but prior to the transfer station.

11. The method of claim 1, wherein the received plurality of droplets of a liquid marking agent are ejected from a plurality of nozzles of the printer, and the printer comprises an inkjet printer.

12. The method of claim 7, wherein printing of the plurality of droplets of a liquid marking agent occurs via ejection from a plurality of nozzles of the printer, and the printer comprises an inkjet printer.

13. The hard imaging device of claim 10, wherein the print device includes a plurality of nozzles to print, via ejection, the plurality of droplets onto the transfer member.

14. The hard imaging device of claim 10, wherein the first supply device is separate from, and independent of, the print device.

15. The method of claim 1, wherein supplying the additive resin material comprises:

feeding the media into a system including the printer; and depositing the additive resin material onto the media along a media delivery path prior to the transfer.

16. The method of claim 1, wherein the transfer member is free of added resin material.

17. The device of claim 10, wherein the transfer station is configured to heat at least the first meltable additive resin material on the media during the transfer of at least ink particles to the media.

18. The device of claim 10, the print device to print at least some of the respective ink particles coated by a second meltable additive resin material.

19. The device of claim 18, wherein the second meltable additive resin material is heated at least one of prior to the transfer station and at the transfer station.

20. The device of claim 19, comprising:

a second supply device located upstream from the transfer station to deposit a third meltable additive resin material onto the transfer member.

21. The device of claim 20, wherein the third meltable additive resin material is heated at least one of prior to the transfer station and at the transfer station.

* * * * *